US011382415B2

(12) United States Patent
Choi

(10) Patent No.: US 11,382,415 B2
(45) Date of Patent: Jul. 12, 2022

(54) FOLDABLE TABLE WITH AUXILIARY SUPPORT

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 0 days.

(21) Appl. No.: 17/192,148

(22) Filed: Mar. 4, 2021

(65) Prior Publication Data

US 2021/0330070 A1 Oct. 28, 2021

(30) Foreign Application Priority Data

Apr. 28, 2020 (CN) ..... 202020680942.X
Jul. 21, 2020 (CN) ..... 202021449249.8

(51) Int. Cl.
*A47B 3/00* (2006.01)
*A47B 3/083* (2006.01)
*A47B 13/08* (2006.01)

(52) U.S. Cl.
CPC ..... *A47B 3/083* (2013.01); *A47B 13/08* (2013.01); *A47B 2003/0835* (2013.01)

(58) Field of Classification Search
CPC ..... A47B 3/083; A47B 3/087; A47B 3/0913; A47B 3/0912; A47B 3/0916; A47B 3/04; A47B 3/30; A47B 13/08; A47B 2003/0835
USPC ..... 108/166, 901, 126, 130–133, 167, 169, 108/171, 174
See application file for complete search history.

(56) References Cited

U.S. PATENT DOCUMENTS 1,063,642 A 6/1913 Birdsell
2,136,569 A 11/1938 Trimpi
2,803,033 A 8/1957 Rachman
3,075,809 A 1/1963 Wilson
3,304,891 A * 2/1967 Rachman ..... A47B 3/083 108/36
3,368,504 A 2/1968 Cohen
(Continued)

FOREIGN PATENT DOCUMENTS

CN 109431070 * 3/2019
EP 1492432 10/2016
(Continued)

*Primary Examiner* — Janet M Wilkens
(74) *Attorney, Agent, or Firm* — Morgan, Lewis & Bockius LLP

(57) ABSTRACT

A foldable table includes a supporting frame, a tabletop and an auxiliary support. The supporting frame includes first and second mounting assemblies pivotally connected to each other at their proximal sides. The tabletop includes a first panel coupled with the first mounting assembly and a second panel coupled with the second mounting assembly such that the first and second panels are rotatable with respect to each other between a folded position and an unfolded position. The auxiliary support includes an auxiliary bar coupled with the supporting frame or the tabletop. When the first and second panels are in the unfolded position, the auxiliary bar is disposed between and coupled with the proximal sides of the first and second panels. As such, the auxiliary support helps align the first and second panels or prevent the proximal sides of the first and second panels from warping, sagging, dislocation or misalignment.

20 Claims, 16 Drawing Sheets

(56) References Cited

U.S. PATENT DOCUMENTS

| | | | | |
|---|---|---|---|---|
| 3,410,232 | A | 11/1968 | Bills | |
| 4,191,111 | A | 3/1980 | Emmert | |
| 5,325,794 | A | 7/1994 | Hontani | |
| 6,508,262 | B1 | 1/2003 | Takayama | |
| 6,752,091 | B2 * | 6/2004 | Glover | A47B 3/087 108/129 |
| 6,843,183 | B2 | 1/2005 | Strong | |
| 7,059,254 | B2 | 6/2006 | Strong et al. | |
| 7,096,799 | B2 | 8/2006 | Strong et al. | |
| 7,097,380 | B2 | 8/2006 | Lee | |
| 7,171,910 | B2 | 2/2007 | Neunzert et al. | |
| 7,428,872 | B2 | 9/2008 | Strong et al. | |
| 7,475,643 | B2 | 1/2009 | Haney et al. | |
| 7,475,644 | B2 | 1/2009 | Strong et al. | |
| 7,634,969 | B2 | 12/2009 | Neunzert et al. | |
| 7,640,870 | B2 | 1/2010 | Strong et al. | |
| 7,644,667 | B2 | 1/2010 | Strong et al. | |
| 7,735,431 | B2 | 6/2010 | Neunzert et al. | |
| 7,874,303 | B2 | 1/2011 | Xie | |
| 8,006,630 | B2 | 8/2011 | Strong et al. | |
| 8,033,228 | B2 | 10/2011 | Haney et al. | |
| 8,042,475 | B2 | 10/2011 | Larcom et al. | |
| 8,156,875 | B2 | 4/2012 | Neunzert et al. | |
| 8,166,894 | B1 * | 5/2012 | Branch | A47B 3/087 108/169 |
| 8,302,541 | B2 | 11/2012 | Haney et al. | |
| 8,342,107 | B2 | 1/2013 | Mover et al. | |
| 8,534,205 | B1 | 9/2013 | Johnson et al. | |
| 8,578,865 | B2 | 11/2013 | Haney et al. | |
| 8,622,007 | B2 | 1/2014 | Peery et al. | |
| 8,746,155 | B2 | 6/2014 | Haney et al. | |
| 8,757,069 | B2 | 6/2014 | Peery et al. | |
| 9,027,952 | B2 | 5/2015 | Zhu | |
| D748,418 | S | 2/2016 | Johnson et al. | |
| 9,277,808 | B2 | 3/2016 | Cai et al. | |
| D756,694 | S | 5/2016 | Johnson et al. | |
| 9,351,563 | B2 | 5/2016 | Bennett et al. | |
| 10,470,561 | B2 | 11/2019 | Clegg et al. | |
| 2003/0089286 | A1 | 5/2003 | Wang | |
| 2004/0187749 | A1 * | 9/2004 | Zhurong | A47B 3/0912 108/169 |
| 2005/0097829 | A1 | 5/2005 | Seo | |
| 2006/0062632 | A1 | 3/2006 | Jang | |
| 2008/0078310 | A1 | 4/2008 | VanNimwegen | |
| 2013/0000528 | A1 | 1/2013 | Jin | |
| 2013/0025507 | A1 * | 1/2013 | Jin | A47B 3/087 108/129 |
| 2013/0233210 | A1 | 9/2013 | Jin | |
| 2014/0030012 | A1 | 1/2014 | Lee | |
| 2014/0099155 | A1 | 4/2014 | Chen | |
| 2014/0130837 | A1 | 5/2014 | Sy-Facunda | |
| 2014/0345506 | A1 * | 11/2014 | Clegg | A47B 3/087 108/169 |
| 2016/0227919 | A1 * | 8/2016 | Turner | A47B 3/083 |
| 2016/0348395 | A1 | 12/2016 | Jin | |
| 2017/0013955 | A1 | 1/2017 | Lin | |
| 2018/0153302 | A1 | 6/2018 | Jiang | |
| 2019/0150608 | A1 | 5/2019 | Johnson et al. | |
| 2019/0284831 | A1 | 9/2019 | Volin | |
| 2019/0292808 | A1 | 9/2019 | Dotterweich | |
| 2021/0345776 | A1 * | 11/2021 | Choi | A47B 3/087 |

FOREIGN PATENT DOCUMENTS

| | | | |
|---|---|---|---|
| WO | 2011097404 | * | 8/2011 |
| WO | WO 2013000149 A1 | | 1/2013 |

* cited by examiner

FOLDABLE TABLE WITH AUXILIARY SUPPORT

CROSS-REFERENCE TO RELATED APPLICATIONS

The present application claims priority to Chinese Utility Model Applications CN 202020680942.X filed Apr. 28, 2020 and CN 202021449249.8 filed Jul. 21, 2020. The disclosure of each application is incorporated herein for all purposes by reference in its entirety.

FIELD OF THE INVENTION

The present invention generally relates to foldable tables and, in particular, to foldable tables with auxiliary supports.

BACKGROUND

Foldable tables are popular because they require less storage space and are easy to carry around. An existing foldable table generally includes two panels rotatable with each other. Each panel is often formed with a flat proximal side wall and, when unfolded, the flat proximal side walls of the two panels face each other. The foldable table with such panels is susceptible to deformation, misalignment or dislocation. For instance, under a load, one panel may shift its position, resulting in a gap or a height difference between the two panels. This not only affects the appearance of the table but also can pinch hands or cause other safety issues.

Given the current state of the art, there remains a need for foldable tables that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides foldable tables with auxiliary supports configured to help stabilize tabletops when the tables are in use.

In various exemplary embodiments, the present disclosure provides a foldable table including a supporting frame, a tabletop and an auxiliary support. The supporting frame includes first and second mounting assemblies pivotally connected to each other at their proximal sides, thereby creating a first pivotal axis. The tabletop includes a first panel coupled with the first mounting assembly and a second panel coupled with the second mounting assembly such that the first and second panels are rotatable with respect to each other around the first pivotal axis between a folded position and an unfolded position. Each of the first and second panels includes a proximal side wall and a groove formed at the proximal side wall. The groove is elongated across at least a portion of the proximal side wall in a lateral direction substantially parallel to the first pivotal axis. When the first and second panels are in the unfolded position, the groove of the first panel and the groove of the second panel collectively form a receptacle extended in the lateral direction. The auxiliary support is configured to assist in stabilizing the first and second panels when they are in the unfolded position. The auxiliary support includes an auxiliary bar coupled with the supporting frame or the tabletop. When the first and second panels are in the unfolded position, laterally, at least a portion of the auxiliary bar is disposed in the receptacle and abuts both the first and second panels.

In some exemplary embodiments, the foldable table further includes a handle connected to the supporting frame or tabletop to facilitate carrying of the foldable table.

In some exemplary embodiments, the supporting frame further includes a first leg assembly connected with the first mounting assembly of the supporting frame and a second leg assembly connected with the second mounting assembly of the supporting frame. When the first and second panels are in the folded position, the first and second leg assemblies and the first and second mounting assemblies are disposed between the first and second panels.

In some exemplary embodiments, the groove is elongated in the lateral direction across the entirety of the proximal side wall.

In some exemplary embodiments, the auxiliary bar is connected to the proximal side wall of the first panel, the proximal side wall of the second panel, or the supporting frame.

In an exemplary embodiment, the auxiliary bar includes first and second ends, each connected to the supporting frame by a coupler.

In some exemplary embodiments, cross-sectional-wise, the receptacle has a rectangular, square, circular, oblong or oval shape.

In an exemplary embodiment, cross-sectional-wise, the receptacle and the auxiliary bar are circular.

In some exemplary embodiments, cross-sectional-wise, the receptacle encloses at least a portion of the auxiliary bar.

In some exemplary embodiments, the auxiliary support includes one or more first connectors each including a base disposed at the auxiliary bar and a crossing piece coupled or formed with the base. For each respective first connector in the one or more first connectors, each of the first and second panels includes a first recess and a second recess formed at the proximal side wall, with the second recess positioned below the first recess. When the first and second panels are in the unfolded position, the first recesses of the first and second panels accommodate the base of the respective first connector and the second recesses of the first and second panels collectively form a depression to accommodate the crossing piece of the first connector such that the crossing piece of the respective first connector abuts both the first and second panels.

In an exemplary embodiment, the second recesses of the first and second panels are configured such that the depression formed by the second recesses has a depth that is substantially the same as a thickness of the crossing piece.

In some exemplary embodiments, the first or second panel has a thickness that is greater at the proximal side of the first or second panel than an average thickness of the first or second panel.

In various exemplary embodiments, the present disclosure provides a foldable table including a supporting frame, a tabletop and an auxiliary support. The supporting frame includes first and second mounting assemblies pivotally connected to each other at proximal sides thereof, thereby creating a first pivotal axis. The tabletop includes a first panel coupled with the first mounting assembly and a second panel coupled with the second mounting assembly such that the first and second panels are rotatable with respect to each other around the first pivotal axis between a folded position and an unfolded position. Each of the first and second panels includes a proximal side wall. The proximal side wall is formed with a step elongated across at least a portion of the proximal side wall in a lateral direction substantially parallel to the first pivotal axis. When the first and second panels are in the unfolded position, the step of the first panel and the step of the second panel collectively form a slot extended in the lateral direction. The auxiliary support is configured to assist in stabilizing the first and second panels when they are in the unfolded position. The auxiliary support includes an auxiliary bar coupled with the supporting frame or the tabletop. When the first and second panels are in the unfolded position, laterally, at least a portion of the auxiliary bar is disposed in the slot and abuts both the first and second panels.

In some exemplary embodiments, the auxiliary support includes one or more first connectors, one or more second connectors, and one or more third connectors. The one or more first connectors are disposed at the auxiliary bar. The one or more second connectors are disposed at the proximal side wall of the first panel. The one or more third connectors are disposed at the proximal side wall of the second panel. When the first and second panels are in the unfolded position, each respective first connector in the one or more first connectors is coupled with a corresponding second connector in the one or more second connectors and a corresponding third connector in the one or more third connectors.

In an exemplary embodiment, each of the first and second panels includes one or more recesses formed at the proximal side wall, and each recess is configured to accommodate a corresponding second or third connector.

In some exemplary embodiments, each of the second and third connectors includes a base segment attached to the proximal side wall of the first or second panel and an extended portion. When the first and second panels are in the unfolded position, the extended portions of the second and third connectors abut the auxiliary bar and retain the auxiliary bar in the slot.

In an exemplary embodiment, when the first and second panels are in the unfolded position, the extended portions of the second and third connectors enclose, cross-sectional-wise, the auxiliary bar within the slot.

In some exemplary embodiments, the respective first connector includes a crossing piece, and each of the second and third connectors includes a recess formed at the extended portion. When the first and second panels are in the unfolded position, the recess at the extended portion of the second connector and the recess at the extended portion of the third connector collectively form a depression to accommodate the crossing piece of the respective first connector, and the crossing piece of the respective first connector abuts both the second and third connectors.

In various exemplary embodiments, the present disclosure provides a foldable table including a supporting frame, a tabletop and an auxiliary support. The supporting frame includes first and second mounting assemblies pivotally connected to each other at proximal sides thereof, thereby creating a first pivotal axis. The tabletop includes a first panel coupled with the first mounting assembly and a second panel coupled with the second mounting assembly such that the first and second panels are rotatable with respect to each other around the first pivotal axis between a folded position and an unfolded position. The auxiliary support is configured to assist in stabilizing the first and second panels when they are in the unfolded position. The auxiliary support includes an auxiliary bar coupled with the supporting frame or the tabletop. The auxiliary support also includes one or more first connectors, one or more second connectors, and one or more third connectors. The one or more first connectors are disposed at the auxiliary bar. The one or more second connectors are disposed at a proximal side of the first panel. The one or more third connectors are disposed at a proximal side of the second panel. When the first and second panels are in the unfolded position, each respective first connector in the one or more first connectors is coupled with a corresponding second connector in the one or more second connectors and a corresponding third connector in the one or more third connectors.

In some exemplary embodiments, the respective first connector includes a crossing piece. Each of the corresponding second and third connectors includes a base segment attached to the proximal side wall of the first or second, an extended portion and a recess formed at the extended portion. When the first and second panels are in the unfolded position, the extended portions of the corresponding second and third connectors enclose, cross-sectional-wise, the auxiliary bar within the slot, the recess at the extended portion of the corresponding second connector and the recess at the extended portion of the corresponding third connector collectively form a depression to accommodate the crossing piece of the respective first connector, and the crossing piece of the respective first connector abuts both the corresponding second and third connectors.

The auxiliary supports and foldable tables of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1:
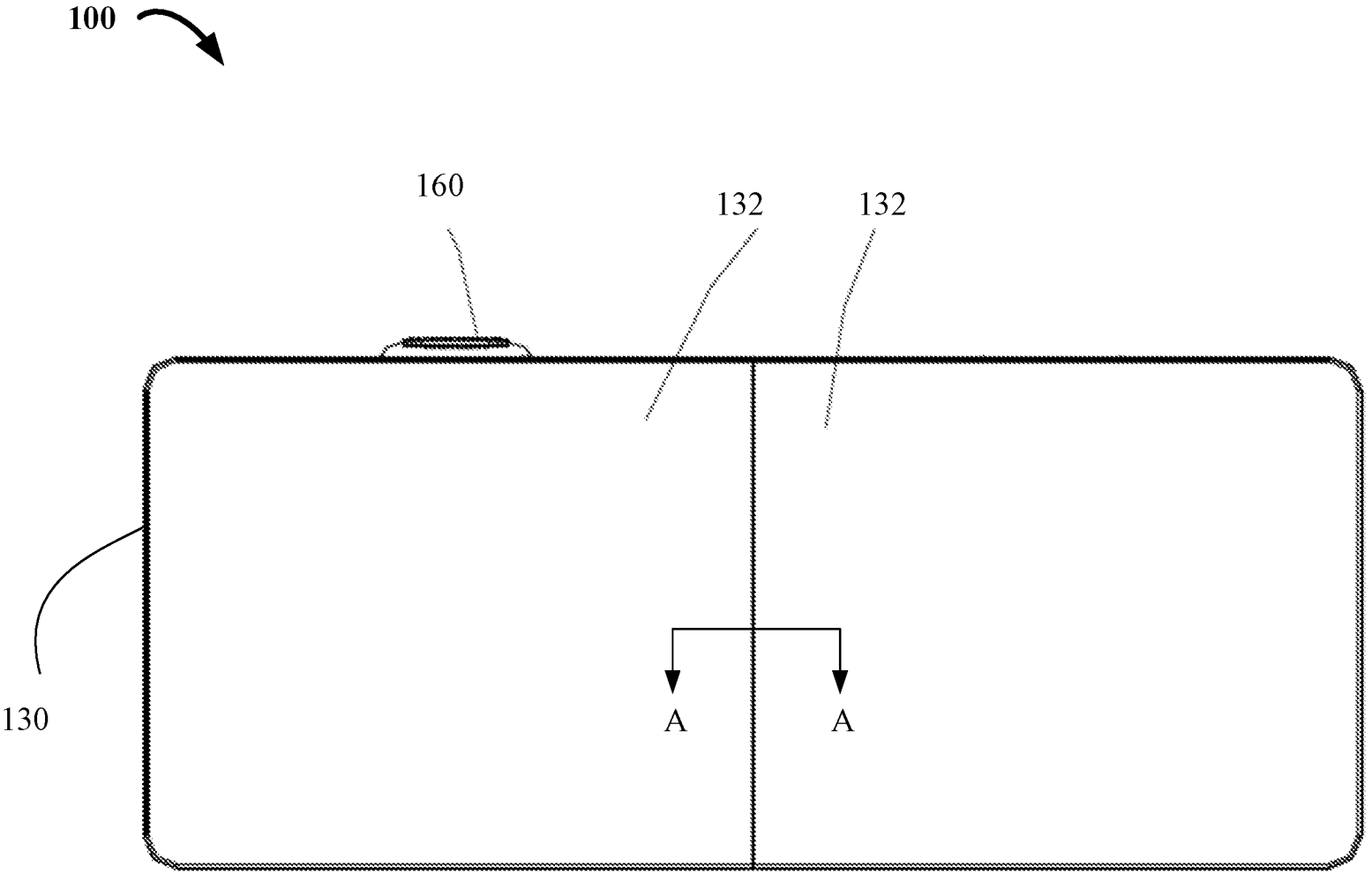
FIG. 1 is a top view illustrating an exemplary foldable table when the tabletop is in an unfolded state in accordance with some exemplary embodiments of the present disclosure.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementations of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present disclosure are described in the context of foldable tables with auxiliary supports. Generally, a foldable table includes a supporting frame, a tabletop and an auxiliary support. The supporting frame includes first and second mounting assemblies pivotally connected to each other at their proximal sides. The tabletop includes a first panel coupled with the first mounting assembly and a second panel coupled with the second mounting assembly such that the first and second panels are rotatable with respect to each other between a folded position and an unfolded position. The auxiliary support includes an auxiliary bar coupled with the supporting frame or the tabletop. When the first and second panels are in the unfolded position, the auxiliary bar is disposed between and coupled with the proximal sides of the first and second panels. As such, the auxiliary support helps align the first and second panels or prevent the proximal sides of the first and second panels from warping, sagging, dislocation or misalignment.

In some exemplary embodiments, the proximal side walls of the first and second panels are formed with groove(s), step(s) or the like to accommodate the auxiliary bar. In some exemplary embodiments, the auxiliary support includes one or more first connectors, one or more second connectors, and/or one or more third connectors, of which the one or more first connectors are disposed at the auxiliary bar, the one or more second connectors are disposed at the proximal side of the first panel, and the one or more third connectors are disposed at the proximal side of the second panels. The proximal side walls of the first and second panels are formed with recesses or the like to accommodate the first, second and/or third connectors. When the first and second panels are in the unfolded position, each first connector is coupled with a second connector disposed at the first panel and a third connector disposed at a second panel.

Figure 4:
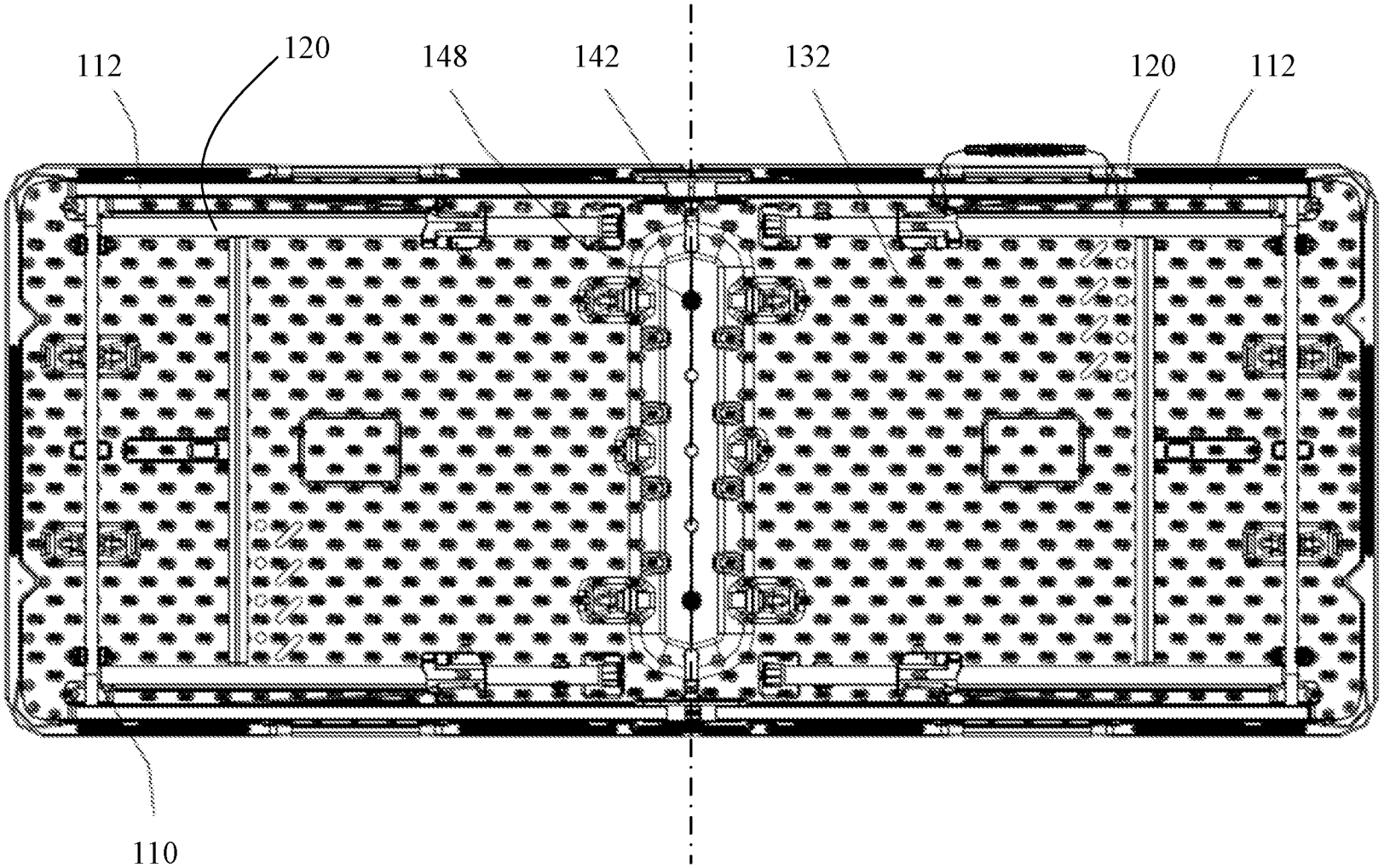
FIG. 4 is a bottom view illustrating the exemplary foldable table of FIG. 1.
Figure 5:
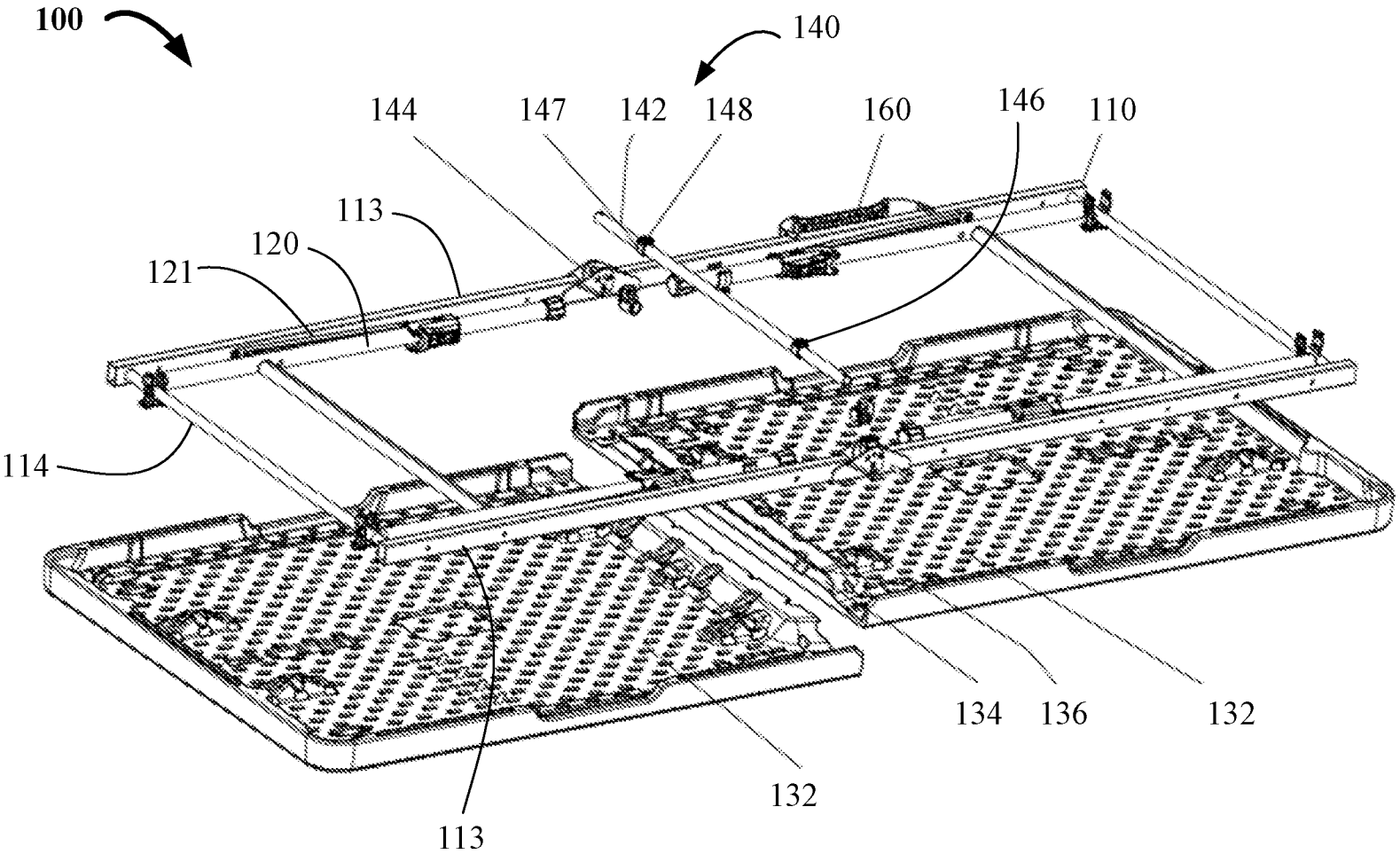
FIG. 5 is a perspective, exploded and partially disassembled view illustrating the exemplary foldable table of FIG. 1.
Figure 5A:
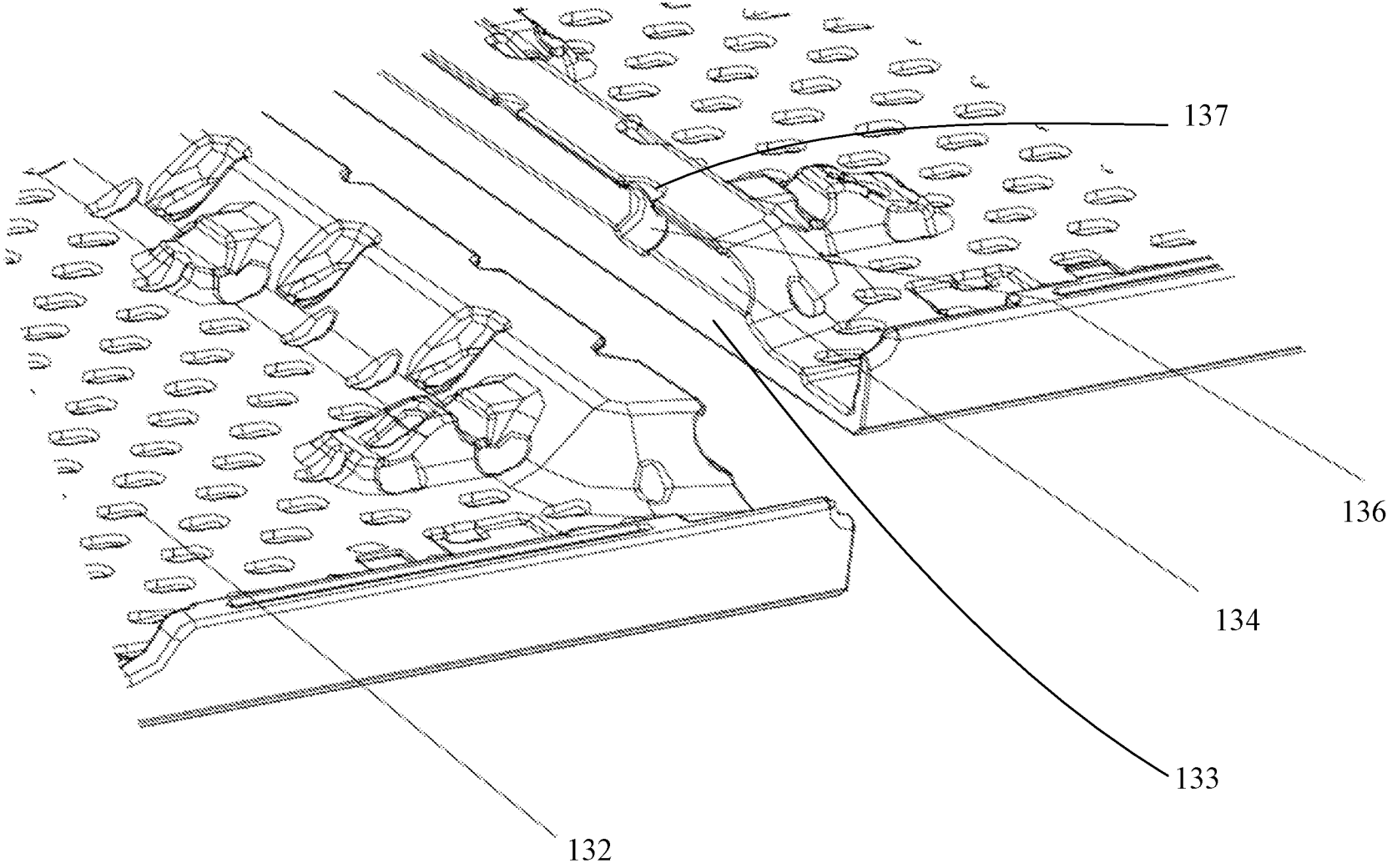
FIG. 5A is a partially enlarged view of FIG. 5.
Figure 5B:
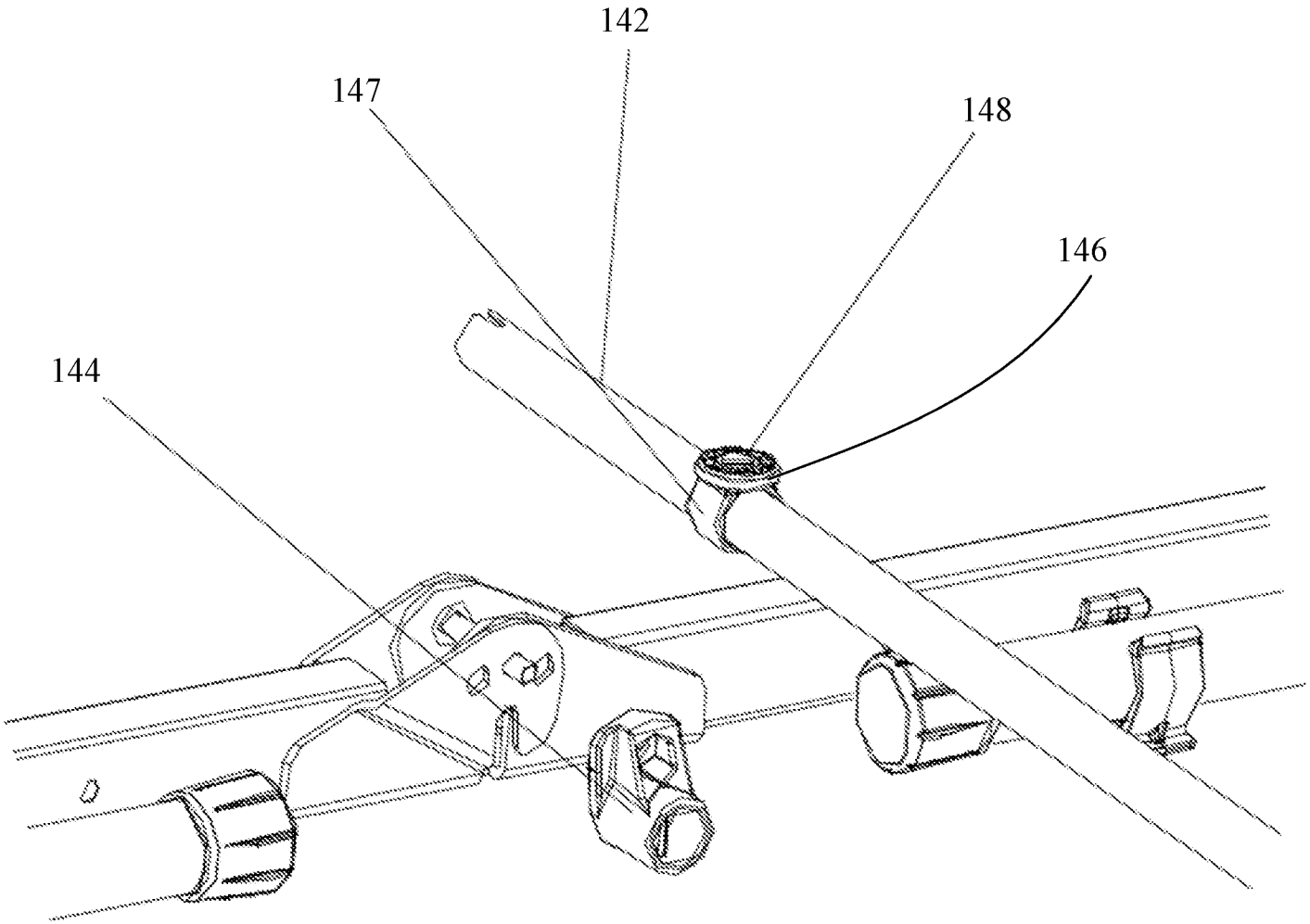
FIG. 5B is another partially enlarged view of FIG. 5.
Figure 6:
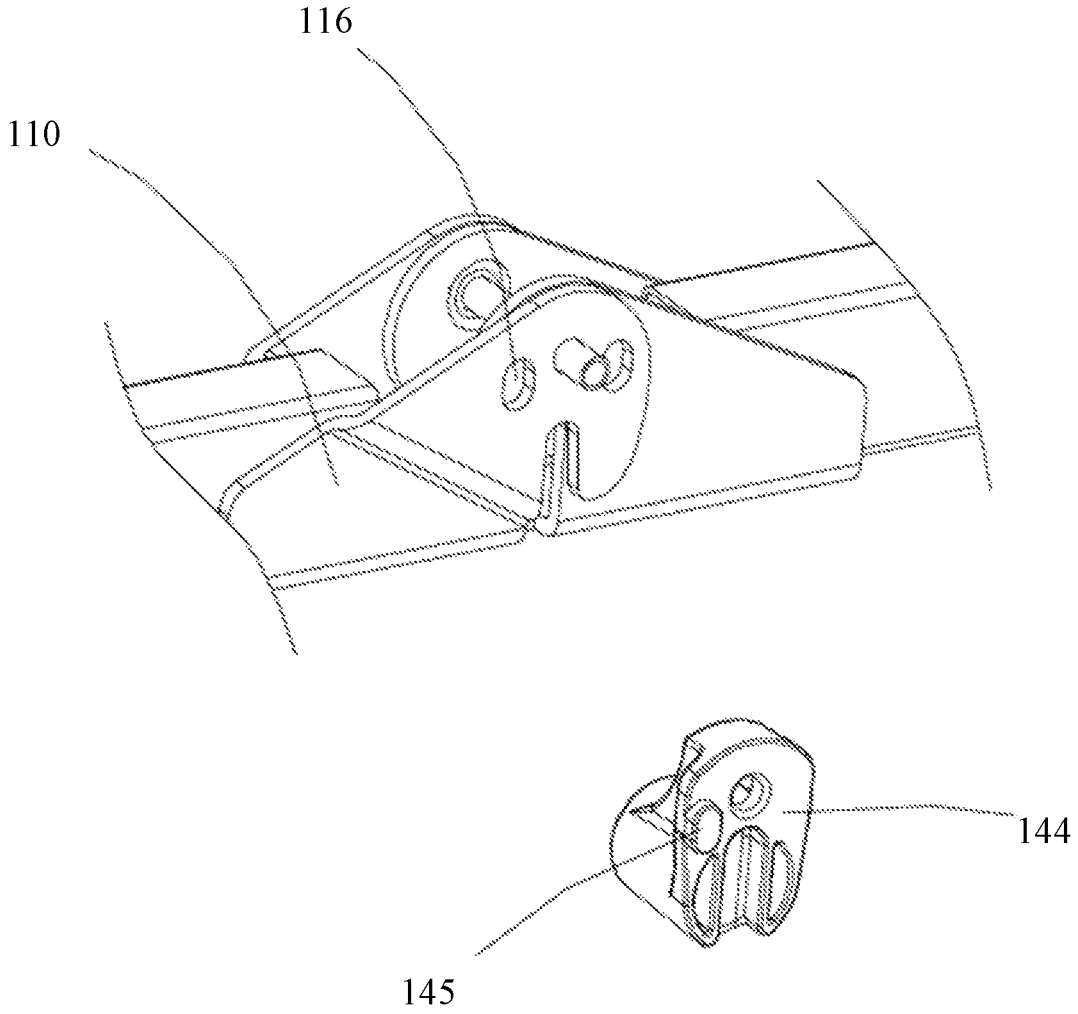
FIG. 6 is a perspective view illustrating some components of the exemplary foldable table of FIG. 1.
Figure 7:
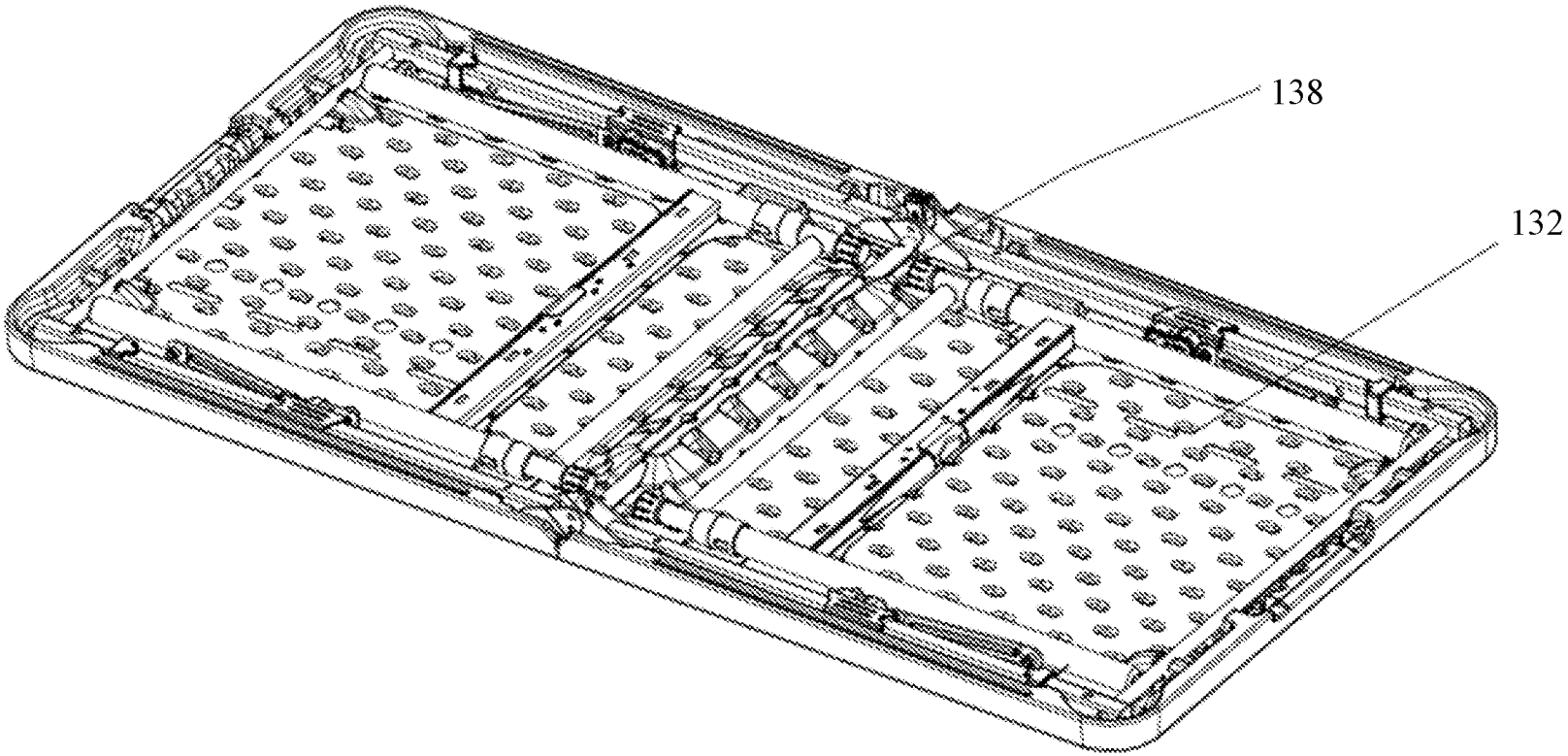
FIG. 7 is a bottom perspective view illustrating the exemplary foldable table of FIG. 1.

Referring now to FIGS. 1, 4 and 5, there is depicted exemplary foldable table 100 in accordance with some exemplary embodiments of the present disclosure. As shown, foldable table 100 includes a supporting frame such as supporting frame 110 and a tabletop such as tabletop 130 coupled with the supporting frame. Foldable table 100 also includes an auxiliary support such as auxiliary support 140 configured to help stabilize the tabletop when the table is unfolded and in use.

Examples of supporting frames are disposed in U.S. patent application Ser. No. 17/142,711 and U.S. patent application Ser. No. 16/838,939, the disclosure of each application is incorporated herein for all purposes by reference in its entirety. In some exemplary embodiments, the supporting frame includes a first mounting assembly and a second mounting assembly, which can be but do not necessarily have to be identical or symmetric with respect to each other. By way of example, FIGS. 4 and 5 illustrates two mounting assemblies 112 that are substantially the same and disposed symmetrically with respect to each other.

The first and second mounting assemblies are pivotally connected with each other at their proximal sides. As used herein, the sides at which first and second mounting assemblies are connected to each other are referred to as their proximal sides, and the sides opposite the proximal sides are referred to as their distal sides. For instance, in FIG. 4, the proximal sides of first and second mounting assemblies are in the middle of the foldable table. The distal sides correspond to the left and right sides of the figure. It should be noted that the term "middle" as used herein does not necessarily mean the center of the frame, and the term "side" does not necessarily mean an outmost edge of the frame.

The pivotal connection of the first and second mounting assemblies creates a pivotal axis, illustrated by the dash dotted line in FIG. 4. As used herein, the direction parallel to the pivotal axis is referred to as the lateral direction of the table and the direction perpendicular to the pivotal axis (e.g., from the left side to right side of FIG. 4) is referred as the longitudinal direction of the table.

In some exemplary embodiments, mounting assembly 112 includes first and second lateral bars 113 spaced apart from each other in the lateral direction and longitudinal bar 114 disposed between and connected to the first and second lateral bars. A leg assembly such as leg assembly 120 is connected to the first or second mounting assembly and rotatable with respect to the first or second panel. When the first and second panels are in the folded position, the mounting and leg assemblies are disposed between the first and second panels. In some exemplary embodiments, a linkage mechanism such as linkage mechanism 121 is provided to help control the rotation of the leg assembly and/or lock the leg assembly when the table is in use.

In some exemplary embodiments, tabletop 130 includes a first panel coupled with the first mounting assembly and a second panel coupled with the second mounting assembly such that the first and second panels are rotatable with respect to each other around the first pivotal axis between a folded position and an unfolded position. The first and second panels can be but do not necessarily have to be identical or symmetric with respect to each other. By way of example, FIGS. 1, 4 and 5 illustrate two panels 132 that are substantially the same and disposed symmetrically with respect to each other.

In some exemplary embodiments, panel 132 is a unitary piece formed by blow molding plastics such as high density polyethylene (HDPE), low density polyethylene (LDPE), polypropylene (PP), polyvinyl chloride (PVC), polyethylene terephthalate (PET), thermoplastic elastomers (TPE), or the like. The panel generally includes a first panel wall, a second panel wall and a generally hollow interior formed between the first and second panel walls. The panel can be of various regular or irregular shapes, including but not limited to a square shape, a half circular shape or a rectangular shape. The panel can have other features, such as depressions, ridges, or the like, monolithically formed with the first and/or second panel walls.

Referring to FIGS. 2-5B, in some exemplary embodiments, each of the first and second panels includes a proximal side wall, and a groove formed at the proximal side wall and elongated across at least a portion of the proximal side wall in the lateral direction of the table. For instance, in some exemplary embodiments, panel 132 includes proximal side wall 133 and groove 134 formed at the proximal side wall (e.g., cross-sectional-wise, the groove is recessed from the proximal side wall toward the dismal side of the panel). Groove 134 is elongated in the lateral direction of the table across at least a portion of the proximal side wall. In an exemplary embodiment, the groove is elongated in the lateral direction of the table across the entire proximal side wall.

The groove formed on the proximal side wall of the first panel and the groove formed on the proximal side wall of the second panel can be but do not necessarily have to be identical or symmetric with respect to each other. Whether they are identical or different and whether they are symmetric or asymmetric, the groove of the first panel and the groove of the second panel collectively form a receptacle such as receptacle 135 extended in the lateral direction when the first and second panels are in the unfolded position. Depending on configuration of the grooves, cross-sectional-wise, the receptable can have various regular or irregular shapes, including but not limited to rectangular, square, circular, oblong or oval shape. In an exemplary embodiment, the grooves of the first and second panels are substantially identical and symmetric with respect to each other, each having a half circular cross section to produce a receptacle with a substantially circular cross section.

Figure 8:
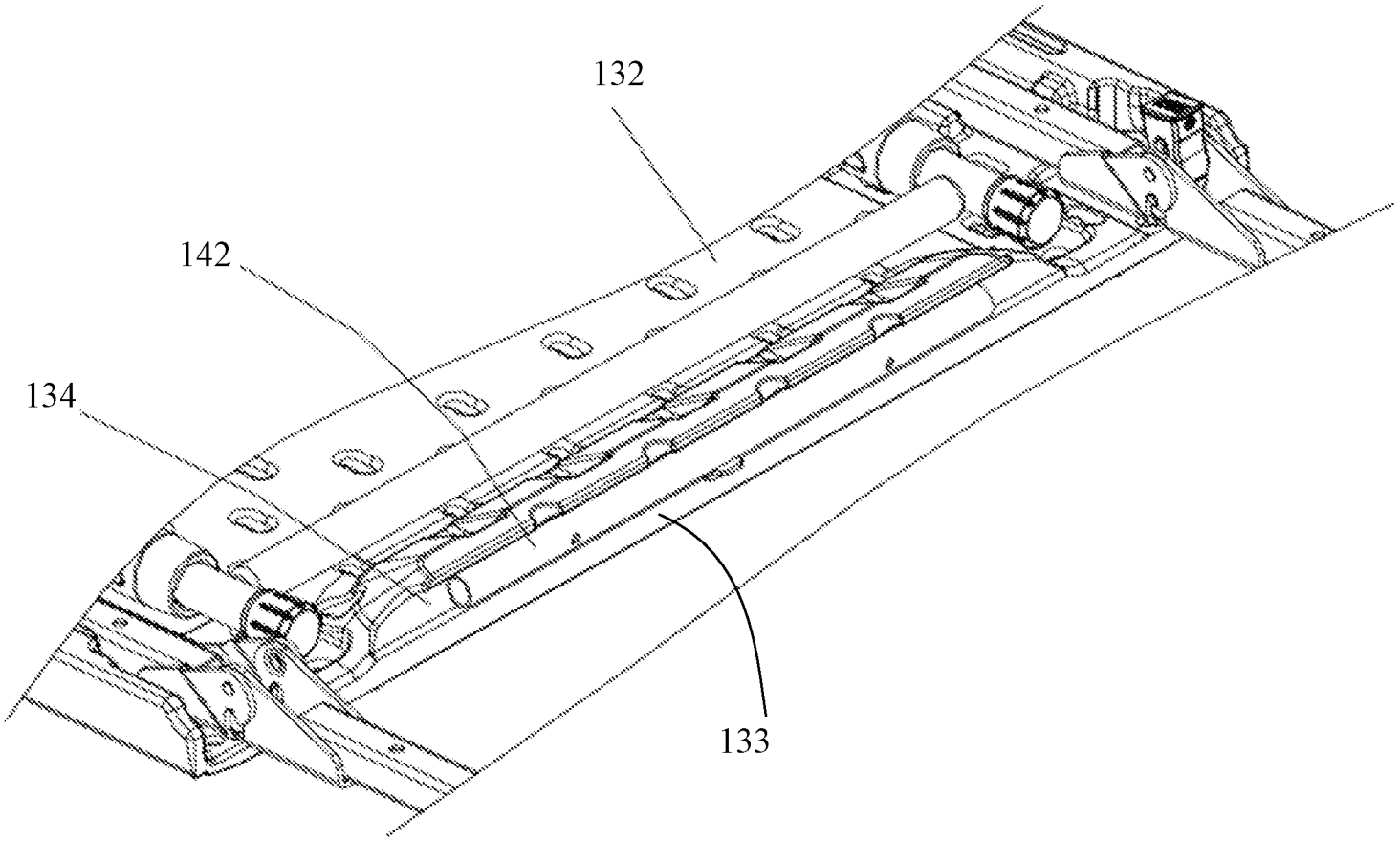
FIG. 8 is a bottom perspective view illustrating some components of an exemplary foldable table in accordance with some exemplary embodiments of the present disclosure.

In some exemplary embodiments, auxiliary support 140 includes an auxiliary bar such as auxiliary bar 142 coupled with the supporting frame or the tabletop. For instance, in some exemplary embodiments, auxiliary bar 142 has first and second ends, each coupled to the supporting frame by a coupler such as coupler 144. In an exemplary embodiment, coupler 144 includes a protrusion such as protrusion 145 configured to be inserted into a hole such as hole 116 formed at the supporting frame. In another exemplary embodiment, auxiliary bar 142 is directly coupled to the supporting frame, for instance, by welding or the like, without the use of any couplers. In a further exemplary embodiment, auxiliary bar 142 is coupled to the proximal side wall of the first or second panel, for instance, by one or more fasteners as illustrated in FIG. 8.

Laterally, when the first and second panels are in the unfolded position, at least a portion of the auxiliary bar is disposed in the receptacle. For instance, in embodiments illustrated in FIG. 5, two end portions of the auxiliary bar are not disclosed in the receptacle because the width of the receptacle in the lateral direction is smaller than the length of the auxiliary bar. In embodiments illustrated in FIG. 8, the entire auxiliary bar is disposed in the receptacle because the width of the receptacle in the lateral direction is greater than the length of the auxiliary bar.

Figure 2:
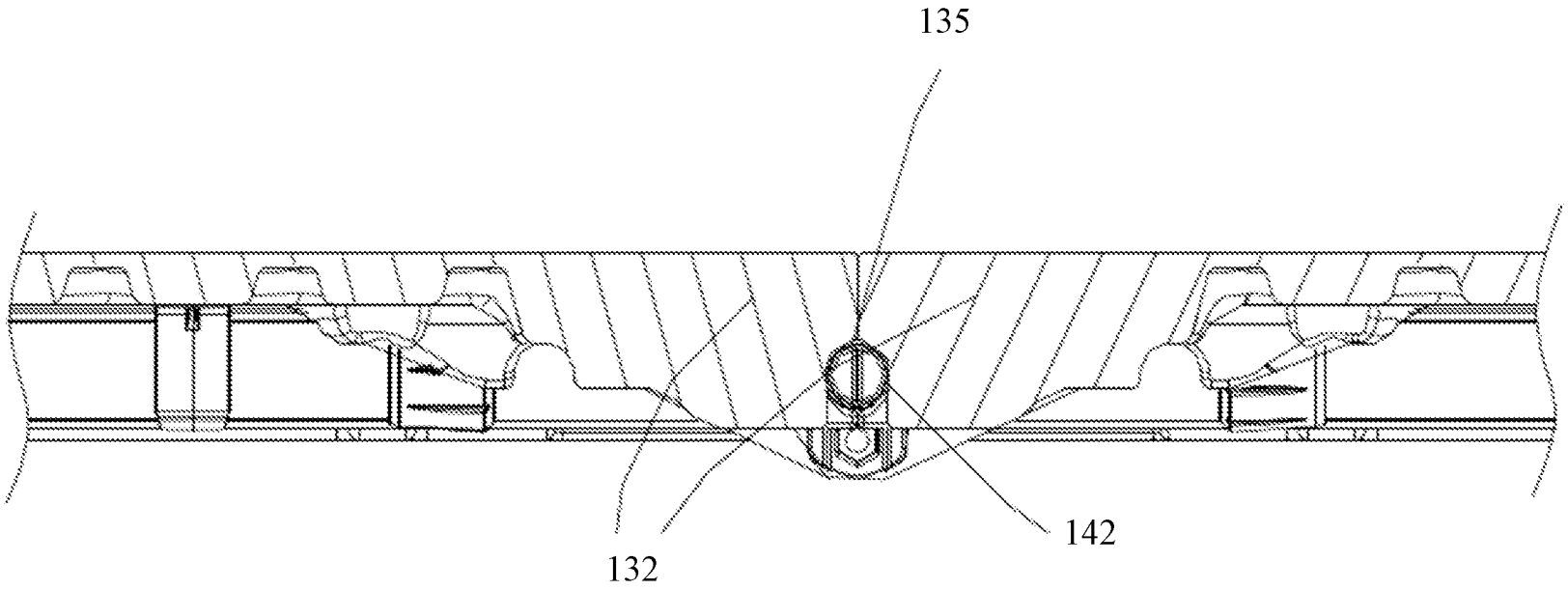
FIG. 2 is a schematic cross-sectional view taken along line A-A of FIG. 1.
Figure 3:
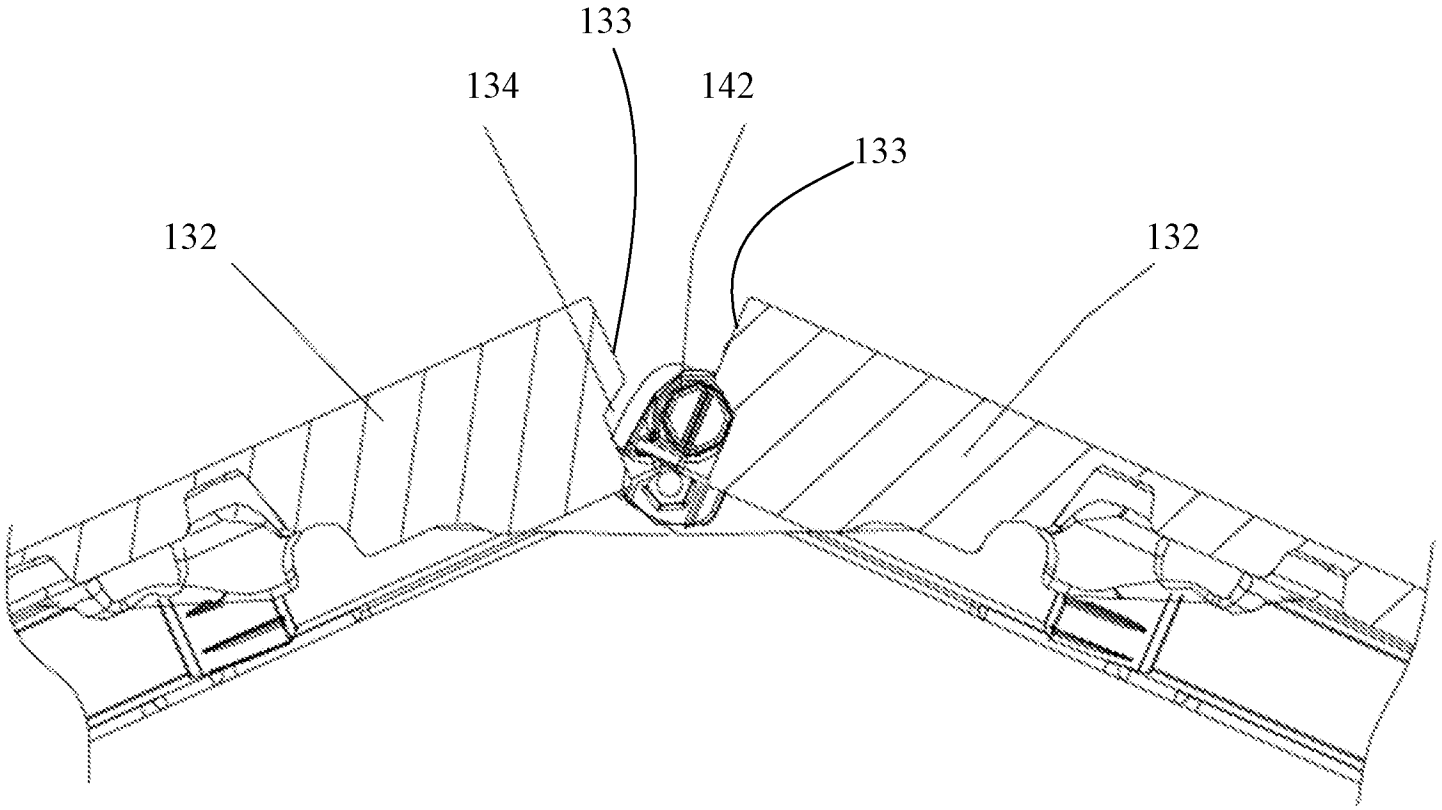
FIG. 3 is a schematic cross-sectional view illustrating an exemplary foldable table when the tabletop is in an intermediate state in accordance with some exemplary embodiments of the present disclosure.

Cross-sectional-wise, when the first and second panels are in the unfolded position, the receptacle encloses at least a portion of the auxiliary bar. For instance, in an exemplary embodiment, cross-sectional-wise, receptacle 135 forms a complete enclosure that encloses the entire auxiliary bar as illustrated in FIG. 2. In an exemplary embodiment, cross-sectional-wise, receptacle 135 forms a partial enclosure that covers only a portion of the auxiliary bar, for instance, covering a portion between half of the auxiliary bar and the entire auxiliary bar.

The auxiliary bar can be solid or hollow (e.g., a tube), and can be made of various materials including but not limited to metals and plastics. Like the receptacle, cross-sectional-wise, the auxiliary bar can have various shapes, regular or irregular, and including but not limited to rectangular, square, circular, oblong or oval shape. In an exemplary embodiment, the auxiliary bar has a substantially circular cross section.

When the first and second panels are in the unfolded position, the auxiliary bar abuts both the first and second panels, causing the first and second panels to move or deform synchronously under a load. As such, the auxiliary support helps align the first and second panels with respect to each other and stabilize the tabletop when the table is in use. It also reduces warping, sagging, dislocation and/or misalignment at the proximal sides of the first and second panels, prevents the occurrence of a gap or height difference between the first and second panels, and improves the appearance and safety of the table.

Referring to FIGS. 4-5B and 7, in some exemplary embodiments, auxiliary support 140 includes one or more first connectors such as first connector 146 disposed at auxiliary bar 142. In an exemplary embodiment, first connector 146 includes a base such as base 147 and a crossing piece such as crossing piece 148. The base is coupled with the auxiliary bar, for instance, the base having a ring-like shape and sleeved and fitted onto the auxiliary bar. The crossing piece is coupled or formed with the base.

To accommodate the one or more first connectors, each of the first and second panels includes one or more first recesses and one or more second recesses formed at the proximal side wall. For instance, in an exemplary embodiment, one or more first recesses 136 and one or more second recesses 137 are formed at proximal side wall 133 of the first or second panel. When the first and second panels are in the unfolded position, a first recess of the first panel and a first recess of the second panel accommodate base 147, and a second recess of the first panel and a second recess of the second panel collectively form a depression such as depression 138 to accommodate crossing piece 148 of a first connector.

When the first and second panels are in the unfolded position, the crossing piece of a first connector abuts both the first and second panels. Moreover, the engagement between the base of the first connector and the first recesses of the first and second panels and the engagement of the crossing piece of the first connector and the second recesses of the first and second panels prevents the auxiliary bar from moving within the receptacle either in the lateral or longitudinal or height direction of the table. This enhances the stability of the auxiliary support and thus helps enhancing the stability of the table.

In some exemplary embodiments, the second recesses of the first and second panels are configured such that the depression formed by the second recesses has a depth that is substantially the same as a thickness of the crossing piece. As such, when the first and second panels are in the unfolded position, the crossing piece of the first connector is leveled substantially with the local lower surfaces of the first and second panels (e.g., the lower surfaces at the proximal sides of the first and second panels). In some exemplary embodiments, the first or second panel has a thickness that is greater at the proximal side of the first or second panel than an average thickness of the first or second panel to facilitate formation of groove(s), step(s), recess(es) or the like at the proximal side wall.

Referring to FIGS. 9-14, there is depicted exemplary foldable table 200 in accordance with some exemplary embodiments of the present disclosure. As shown, foldable table 200 includes a supporting frame such as supporting frame 110 and a tabletop such as tabletop 230 coupled with the supporting frame. Foldable table 200 also includes an auxiliary support such as auxiliary support 140 configured to help stabilize the tabletop when the table is unfolded and in use.

Figure 9:
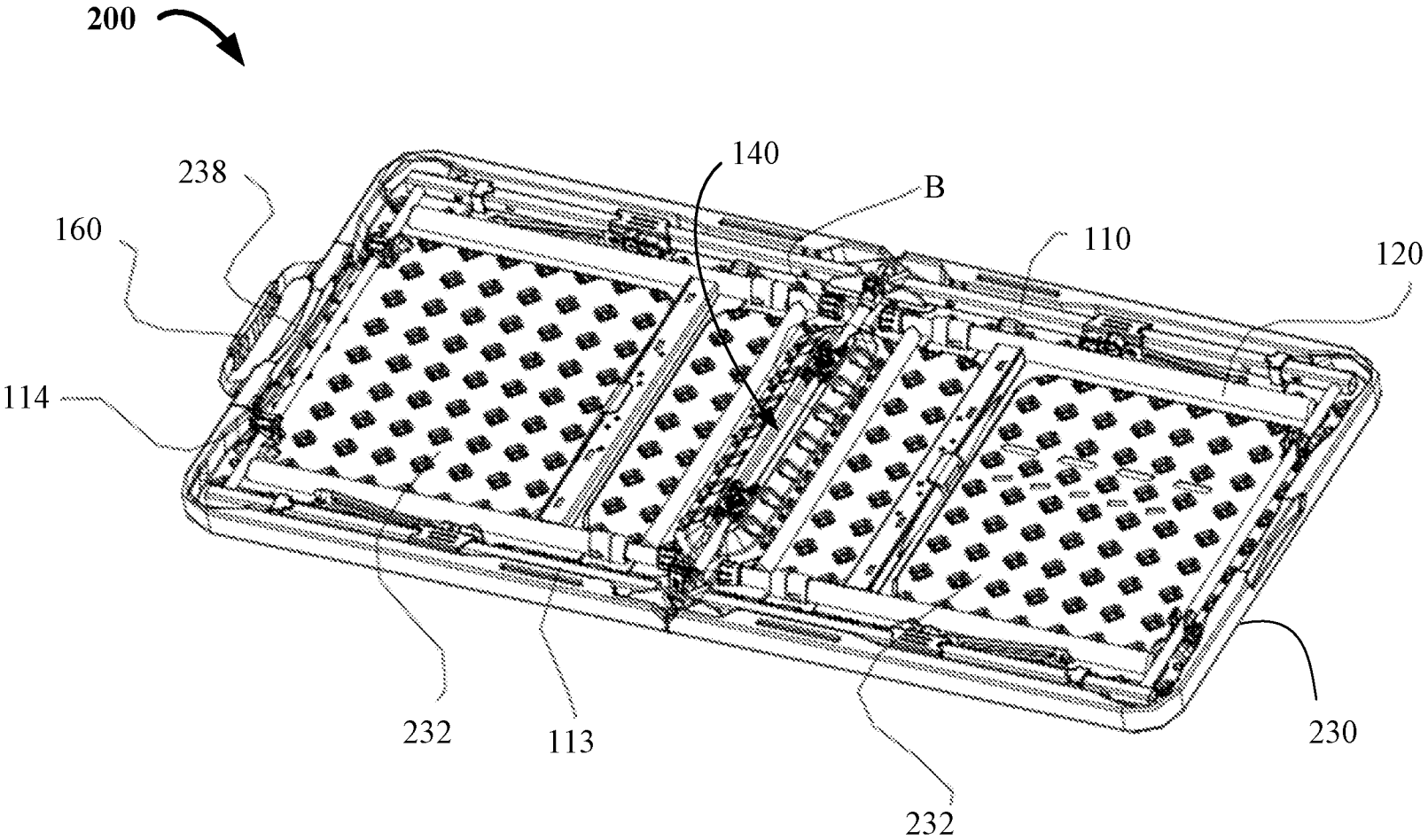
FIG. 9 is a bottom perspective view illustrating an exemplary foldable table in accordance with some exemplary embodiments of the present disclosure.
Figure 11:
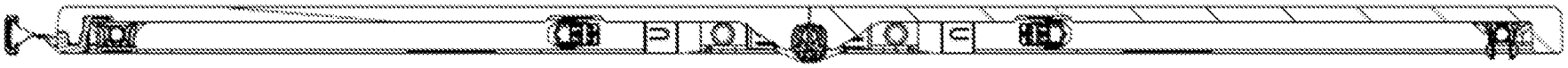
FIG. 11 is a schematic cross-sectional view illustrating the exemplary foldable table of FIG. 9.
Figure 12:
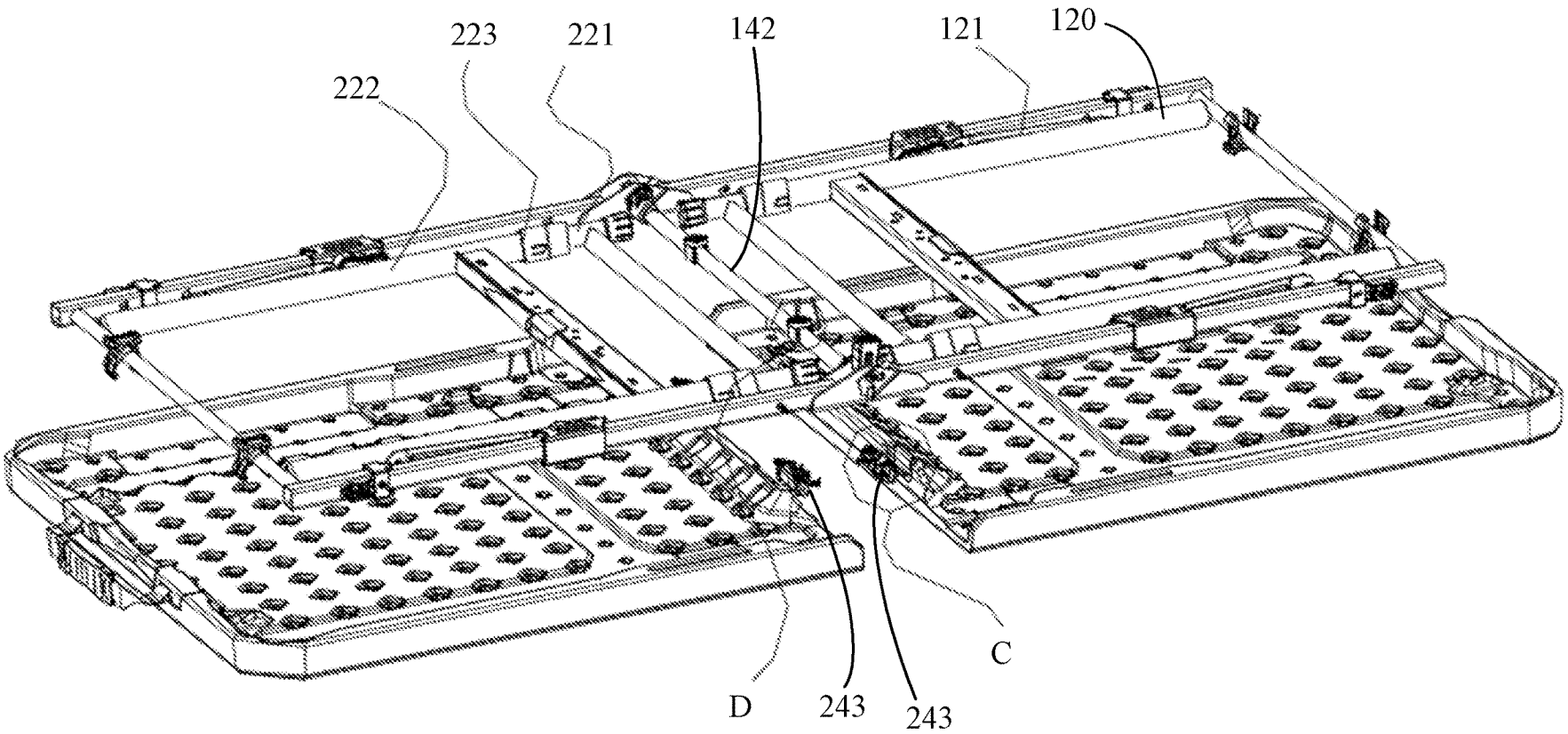
FIG. 12 is a perspective, exploded and partially disassembled view illustrating the exemplary foldable table of FIG. 9.
Figure 13:
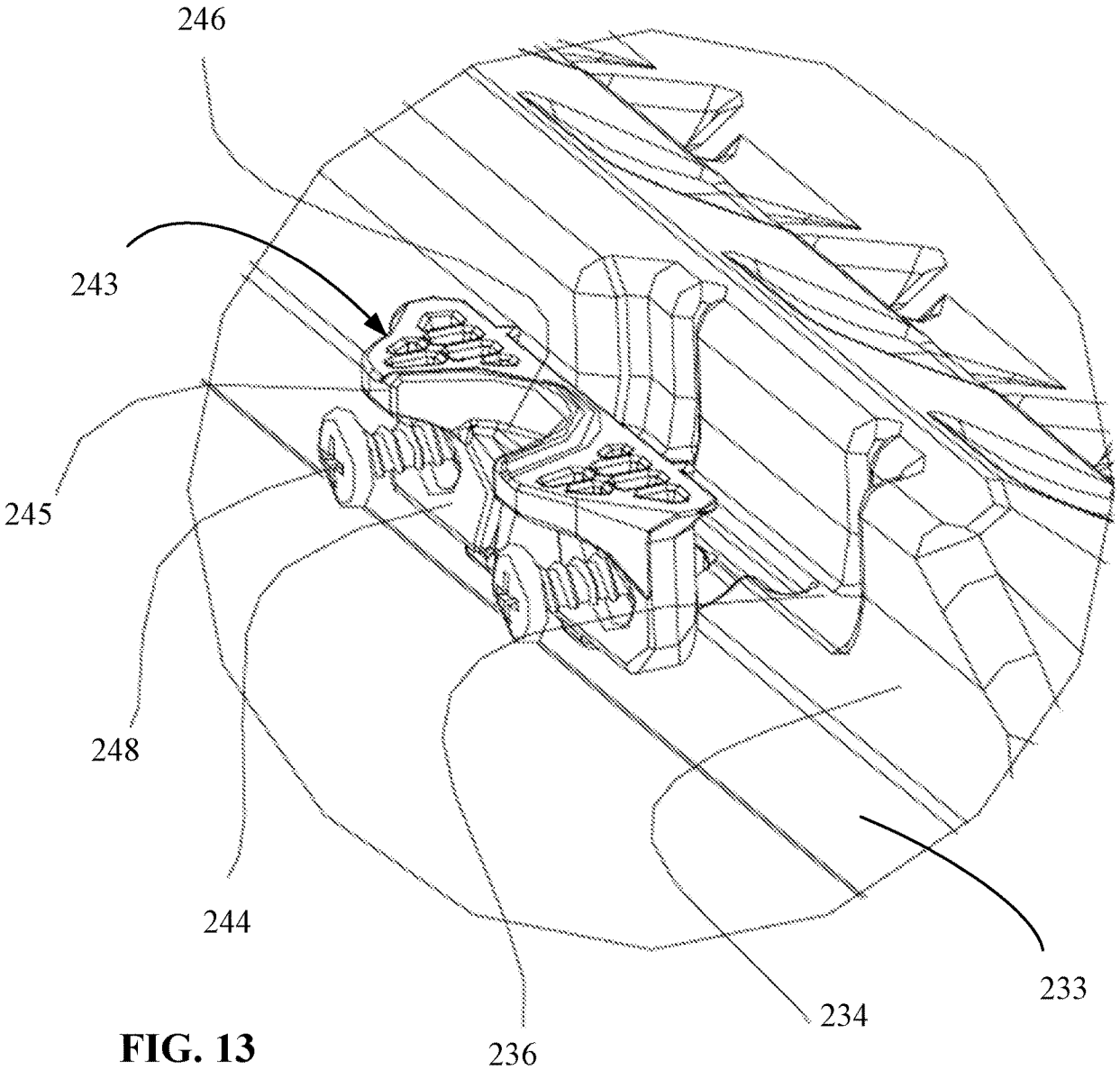
FIG. 13 is an enlarged view taken along circle C of FIG. 12.
Figure 14:
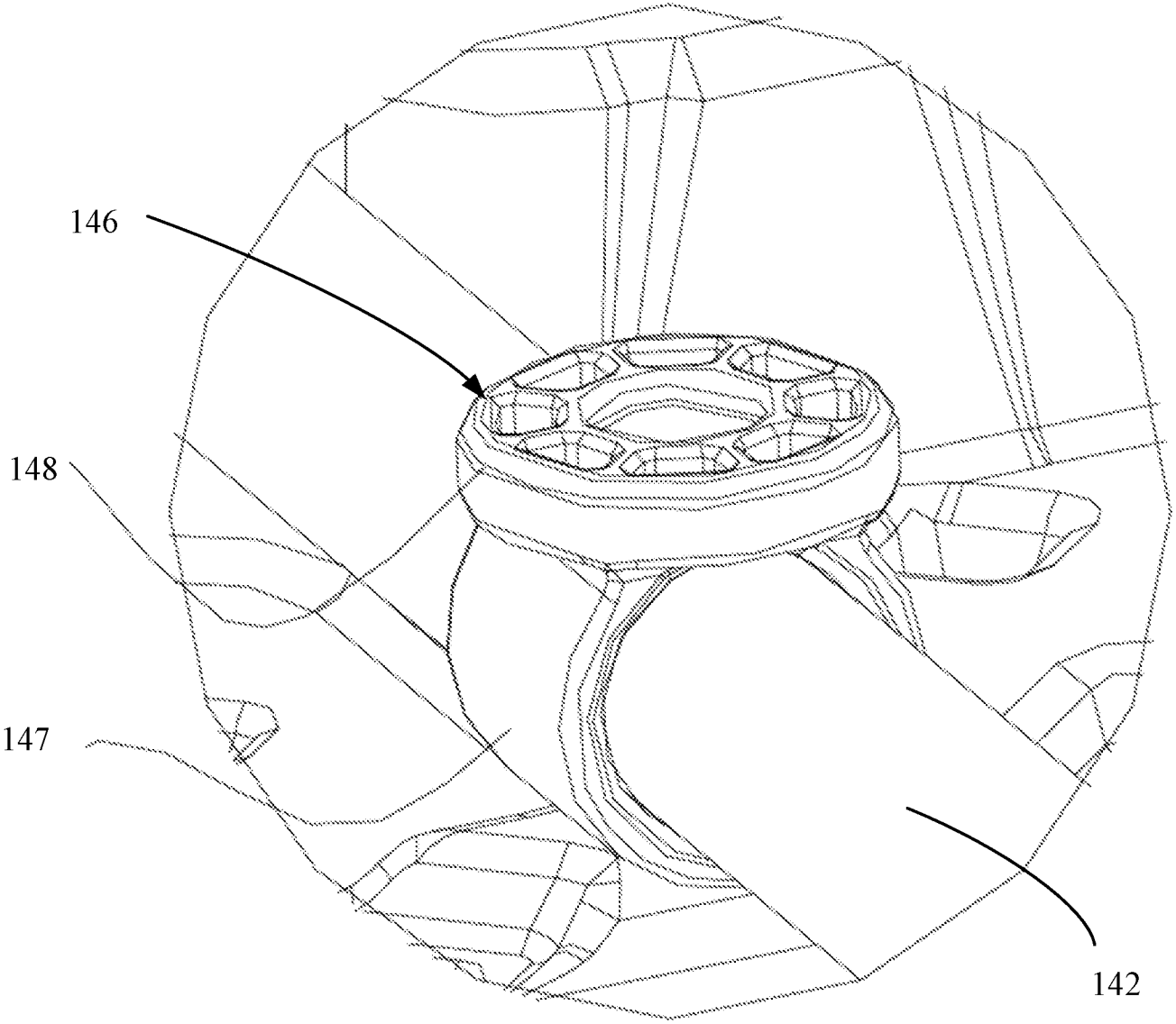
FIG. 14 is an enlarged view taken along circle D of FIG. 12.

Like tabletop 130, tabletop 230 includes a first panel coupled with the first mounting assembly and a second panel coupled with the second mounting assembly such that the first and second panels are rotatable with respect to each other around the first pivotal axis between a folded position and an unfolded position. The first and second panels can be but do not necessarily have to be identical or symmetric with respect to each other. By way of example, FIGS. 9, 11 and 12 illustrate two panels 232 that are substantially the same and disposed symmetrically with respect to each other.

In some exemplary embodiments, each of the first and second panels includes a proximal side wall, and a step formed at the proximal side wall and elongated across at least a portion of the proximal side wall in the lateral direction of the table. For instance, in some exemplary embodiments, panel 232 includes proximal side wall 233 and step 234 formed at the proximal side wall. Step 234 is elongated in the lateral direction of the table across at least a portion of the proximal side wall. In an exemplary embodiment, the step is elongated in the lateral direction of the table across the entire proximal side wall.

Figure 10:
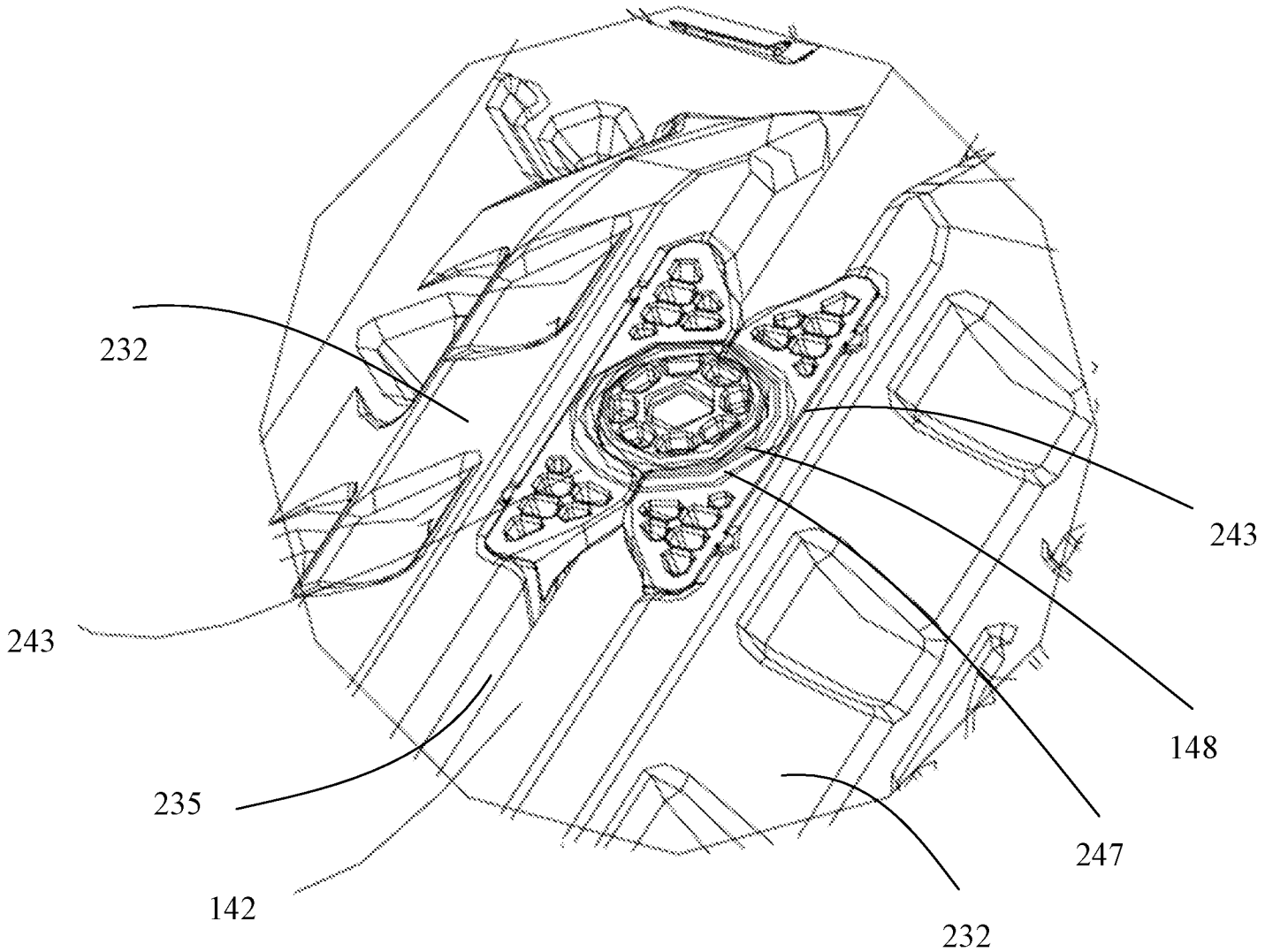
FIG. 10 is an enlarged view taken along circle B of FIG. 9.

The step formed on the proximal side wall of the first panel and the step formed on the proximal side wall of the second panel can be but do not necessarily have to be identical or symmetric with respect to each other. Whether they are identical or different and whether they are symmetric or asymmetric, the step of the first panel and the step of the second panel collectively form a slot such as slot 235 extended in the lateral direction when the first and second panels are in the unfolded position. Laterally, the slot receives at least a portion of auxiliary bar 142 when the first and second panels are in the unfolded position. Cross-sectional-wise, the slot is generally open, e.g., having an opening facing downward. As such, cross-sectional-wise, the slot encloses only a portion of the auxiliary bar, and the remaining portion of the auxiliary bar is exposed to the outside as illustrated in FIG. 10.

In some exemplary embodiments, corresponding to each first connector 146, auxiliary support 140 includes a second connector disposed at the proximal side (e.g., the proximal side wall) of the first panel and a third connector disposed at the proximal side (e.g., the proximal side wall) of the second panel. The second and third connectors can be but do not necessarily have to be identical or symmetric with respect to each other. By way of example, FIGS. 10 and 12 illustrate two connectors 243 that are substantially the same and disposed symmetrically with respect to each other. In an exemplary embodiment, proximal side wall 233 of the first or second panel is formed with one or more recesses 236 each for accommodating at least a portion of connector 243.

In some exemplary embodiments, connector 243 includes a base segment such as base segment 244, an extended segment such as extended portion 245 and a recess such as recess 246 formed at the extended segment. The base segment is attached to the first or second panel, for instance, by one or more fasteners 248. When the first and second panels are in the unfolded position, extended segments 243 of the second and third connectors abut the auxiliary bar and retain the auxiliary bar in the slot. In some exemplary embodiments, when the first and second panels are in the unfolded position, extended segments 243 of the second and third connectors enclose, cross-sectional-wise, auxiliary bar 142 within slot 235 as illustrated in FIG. 10. In addition, recesses 246 of the second and third connectors collectively form a depression such as depression 247 to accommodate crossing piece 148 of a first connector.

As such, when the first and second panels are in the unfolded position, the crossing piece of the first connector abuts both the second and third connectors. In an exemplary embodiment, when the first and second panels are in the unfolded position, the crossing piece of the first connector abuts the base segments of the second and third connectors. Moreover, the first connector is coupled with both the second and third connectors in such a way that the first, second and third connectors collectively prevent the auxiliary bar from disengaging from the slot and from moving within the slot in the lateral or longitudinal or height direction of the table. This enhances the stability of the auxiliary support and help stabilize the foldable table when the table is in use.

In some exemplary embodiments, the first, second and/or third connectors are formed with recesses, holes, notches or the like to reduce the weight of the connectors and the consumption of the material(s).

The foldable tables disclosed herein can include additional, optional or alternative features. For instance, as an example, a foldable table can include a handle such as handle 160 to facilitate carrying of the foldable table. The handle can be connected to the supporting frame as illustrated in FIGS. 4 and 5 or connected to the tabletop as illustrated in FIGS. 9 and 12.

As another example, a leg assembly can be non-adjustable as illustrated in FIGS. 4 and 5 or adjustable as illustrated in FIGS. 9 and 12. Adjustable leg assemblies allow one to adjust the height of the table to meet one's preferences and different needs. In some exemplary embodiments, a leg of an adjustable leg assembly includes two bars such as first bar 221 and second bar 222 telescopically coupled with each other and a controller such as controller 223 configured to lock and/unlock the first and second bars.

As a further example, in some exemplary embodiments, one or more notches are additionally or optionally formed at an edge or a lip of the tabletop. For instance, as illustrated in FIGS. 9 and 12, one notch 238 is formed at the first panel adjacent to where the handle is attached, and the other notch is formed at the second panel. When the first and second panels are in the folded position, the notches at the first and second panels face each other and facilitate unfolding of the panels with hands or the like.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first segment could be termed a second segment, and, similarly, a second segment could be termed a first segment, without changing the meaning of the description, so long as all occurrences of the "first segment" are renamed consistently and all occurrences of the "second segment" are renamed consistently.

What is claimed is:

1. A foldable table comprising:

a supporting frame comprising first and second mounting assemblies pivotally connected to each other at proximal sides thereof, thereby creating a first pivotal axis;

a tabletop comprising a first panel coupled with the first mounting assembly and a second panel coupled with the second mounting assembly such that the first and second panels are rotatable with respect to each other around the first pivotal axis between a folded position and an unfolded position, wherein each of the first and second panels comprises a proximal side wall and a groove formed at the proximal side wall, the groove elongated across at least a portion of the proximal side wall in a lateral direction substantially parallel to the first pivotal axis; and when the first and second panels are in the unfolded position, the groove of the first panel and the groove of the second panel collectively form a receptacle extended in the lateral direction; and an auxiliary support configured to assist in stabilizing the first and second panels when they are in the unfolded position, the auxiliary support comprising an auxiliary bar coupled with the supporting frame or the tabletop, wherein when the first and second panels are in the unfolded position, laterally, at least a portion of the auxiliary bar is disposed in the receptacle and abuts both the first and second panels, wherein the first or second panel has a thickness that is greater at the proximal side of the first or second panel than an average thickness of the first or second panel.

2. The foldable table of claim 1, further comprising a handle connected to the supporting frame or tabletop to facilitate carrying of the foldable table.

3. The foldable table of claim 1, wherein the supporting frame further comprises:

a first leg assembly connected with the first mounting assembly of the supporting frame; and a second leg assembly connected with the second mounting assembly of the supporting frame, wherein when the first and second panels are in the folded position, the first and second leg assemblies and the first and second mounting assemblies are disposed between the first and second panels.

4. The foldable table of claim 1, wherein the groove is elongated in the lateral direction across the entirety of the proximal side wall.

5. The foldable table of claim 1, wherein the auxiliary bar is connected to the proximal side wall of the first panel, the proximal side wall of the second panel, or the supporting frame.

6. The foldable table of claim 5, wherein the auxiliary bar comprises first and second ends, each connected to the supporting frame by a coupler.

7. The foldable table of claim 1, wherein cross-sectional-wise, the receptacle has a rectangular, square, circular, oblong or oval shape.

8. The foldable table of claim 1, wherein cross-sectional-wise, the receptacle and the auxiliary bar are circular.

9. The foldable table of claim 1, wherein cross-sectional-wise, the receptacle encloses at least a portion of the auxiliary bar.

10. The foldable table of claim 1, wherein the groove is in a form of a step, and the receptacle is in a form of a slot.

11. The foldable table of claim 1, wherein for at least a portion of the auxiliary bar along the lateral direction, the receptacle encloses, cross-sectional-wise, substantially an entirety of the auxiliary bar.

12. A foldable table comprising:

a supporting frame comprising first and second mounting assemblies pivotally connected to each other at proximal sides thereof, thereby creating a first pivotal axis;

a tabletop comprising a first panel coupled with the first mounting assembly and a second panel coupled with the second mounting assembly such that the first and second panels are rotatable with respect to each other around the first pivotal axis between a folded position and an unfolded position, wherein each of the first and second panels comprises a proximal side wall and a groove formed at the proximal side wall, the groove elongated across at least a portion of the proximal side wall in a lateral direction substantially parallel to the first pivotal axis; and when the first and second panels are in the unfolded position, the groove of the first panel and the groove of the second panel collectively form a receptacle extended in the lateral direction; and an auxiliary support configured to assist in stabilizing the first and second panels when they are in the unfolded position, the auxiliary support comprising an auxiliary bar coupled with the supporting frame or the tabletop, wherein when the first and second panels are in the unfolded position, laterally, at least a portion of the auxiliary bar is disposed in the receptacle and abuts both the first and second panels;

wherein:

the auxiliary support comprises one or more first connectors each comprising a base disposed at the auxiliary bar and a crossing piece coupled or formed with the base; and for each respective first connector in the one or more first connectors, each of the first and second panels comprises a first recess and a second recess formed at the proximal side wall, with the second recess positioned below the first recess, wherein when the first and second panels are in the unfolded position, the first recesses of the first and second panels accommodate the base of the respective first connector and the second recesses of the first and second panels collectively form a depression to accommodate the crossing piece of the first connector such that the crossing piece of the respective first connector abuts both the first and second panels.

13. The foldable table of claim 12, where the second recesses of the first and second panels are configured such that the depression formed by the second recesses has a depth that is substantially the same as a thickness of the crossing piece.

14. A foldable table comprising:

a supporting frame comprising first and second mounting assemblies pivotally connected to each other at proximal sides thereof, thereby creating a first pivotal axis;

a tabletop comprising a first panel coupled with the first mounting assembly and a second panel coupled with the second mounting assembly such that the first and second panels are rotatable with respect to each other around the first pivotal axis between a folded position and an unfolded position, wherein each of the first and second panels comprises a proximal side wall, wherein the proximal side wall is formed with a step elongated across at least a portion of the proximal side wall in a lateral direction substantially parallel to the first pivotal axis; and when the first and second panels are in the unfolded position, the step of the first panel and the step of the second panel collectively form a slot extended in the lateral direction; and an auxiliary support configured to assist in stabilizing the first and second panels when they are in the unfolded position, the auxiliary support comprising an auxiliary bar coupled with the supporting frame or the tabletop, wherein when the first and second panels are in the unfolded position, laterally, at least a portion of the auxiliary bar is disposed in the slot and abuts both the first and second panels, wherein the auxiliary support comprises:

one or more first connectors disposed at the auxiliary bar;

one or more second connectors disposed at the proximal side wall of the first panel; and one or more third connectors disposed at the proximal side wall of the second panel, wherein, when the first and second panels are in the unfolded position, each respective first connector in the one or more first connectors is coupled with a corresponding second connector in the one or more second connectors and a corresponding third connector in the one or more third connectors.

15. The foldable table of claim 14, wherein each of the first and second panels comprises one or more recesses formed at the proximal side wall, each recess configured to accommodate a corresponding second or third connector.

16. The foldable table of claim 14, wherein each of the second and third connectors comprises a base segment attached to the proximal side wall of the first or second panel and an extended portion, wherein when the first and second panels are in the unfolded position, the extended portions of the second and third connectors abut the auxiliary bar and retain the auxiliary bar in the slot.

17. The foldable table of claim 16, wherein when the first and second panels are in the unfolded position, the extended portions of the second and third connectors enclose, cross-sectional-wise, the auxiliary bar within the slot.

18. The foldable table of claim 16, wherein:

the respective first connector comprises a crossing piece;

each of the second and third connectors comprises a recess formed at the extended portion;

when the first and second panels are in the unfolded position, the recess at the extended portion of the second connector and the recess at the extended portion of the third connector collectively form a depression to accommodate the crossing piece of the respective first connector, and the crossing piece of the respective first connector abuts both the second and third connectors.

19. A foldable table comprising:

a supporting frame comprising first and second mounting assemblies pivotally connected to each other at proximal sides thereof, thereby creating a first pivotal axis;

a tabletop comprising a first panel coupled with the first mounting assembly and a second panel coupled with the second mounting assembly such that the first and second panels are rotatable with respect to each other around the first pivotal axis between a folded position and an unfolded position; and an auxiliary support configured to assist in stabilizing the first and second panels when they are in the unfolded position, the auxiliary support comprising:

an auxiliary bar coupled with the supporting frame or the tabletop;

one or more first connectors disposed at the auxiliary bar;

one or more second connectors disposed at a proximal side of the first panel; and one or more third connectors disposed at a proximal side of the second panel, wherein, when the first and second panels are in the unfolded position, each respective first connector in the one or more first connectors is coupled with a corresponding second connector in the one or more second connectors and a corresponding third connector in the one or more third connectors.

20. The foldable table of claim 19, wherein:

the respective first connector comprises a crossing piece;

each of the corresponding second and third connectors comprises a base segment attached to the proximal side wall of the first or second, an extended portion and a recess formed at the extended portion;

when the first and second panels are in the unfolded position, the extended portions of the corresponding second and third connectors enclose, cross-sectional-wise, the auxiliary bar within the slot, the recess at the extended portion of the corresponding second connector and the recess at the extended portion of the corresponding third connector collectively form a depression to accommodate the crossing piece of the respective first connector, and the crossing piece of the respective first connector abuts both the corresponding second and third connectors.

* * * * *